US012082713B2

(12) United States Patent
Illers et al.

(10) Patent No.: US 12,082,713 B2
(45) Date of Patent: Sep. 10, 2024

(54) PRODUCT DISPLAY UNITS WITH HINGES

(71) Applicant: Marmon Foodservice Technologies, Inc., Osseo, MN (US)

(72) Inventors: Marty Illers, Yonkers, NY (US); John D. Connell, Bay Shore, NY (US)

(73) Assignee: Marmon Foodservice Technologies, Inc., Osseo, MN (US)

( * ) Notice: Subject to any disclaimer, the term of this patent is extended or adjusted under 35 U.S.C. 154(b) by 0 days.

(21) Appl. No.: 18/308,314

(22) Filed: Apr. 27, 2023

(65) Prior Publication Data

US 2023/0346138 A1 Nov. 2, 2023

Related U.S. Application Data

(60) Provisional application No. 63/336,385, filed on Apr. 29, 2022.

(51) Int. Cl.

| | |
|---|---|
| ***A47F 1/12*** | (2006.01) |
| ***A47B 57/58*** | (2006.01) |
| ***A47B 65/00*** | (2006.01) |
| ***A47B 96/04*** | (2006.01) |
| ***A47F 5/00*** | (2006.01) |

(52) U.S. Cl.

CPC ..... *A47F 1/12* (2013.01); *A47B 57/58* (2013.01); *A47B 65/15* (2014.12); *A47B 96/04* (2013.01); *A47F 5/0025* (2013.01); *A47F 5/005* (2013.01)

(58) Field of Classification Search

CPC ..... A47F 1/12; A47F 5/0025; A47F 5/005; A47F 5/132; A47F 1/125; A47B 57/58; A47B 65/15; A47B 96/04

USPC ..... 211/74, 184, 59.2, 119.003; 108/60, 61

See application file for complete search history.

(56) References Cited

U.S. PATENT DOCUMENTS

| | | | | | |
|---|---|---|---|---|---|
| 3,501,019 | A * | 3/1970 | Armstrong | A47B 57/58 | 211/184 |
| 3,703,964 | A * | 11/1972 | Field | A47F 5/005 | 24/537 |
| 4,460,096 | A * | 7/1984 | Ricci | A47F 5/005 | 211/184 |
| 4,488,653 | A * | 12/1984 | Belokin | A47F 5/005 | 211/DIG. 1 |
| 4,712,694 | A * | 12/1987 | Breslow | A47F 5/005 | 211/184 |
| 5,242,223 | A * | 9/1993 | Koves | A47B 88/90 | 312/348.3 |

(Continued)

*Primary Examiner* — Jennifer E. Novosad

(74) *Attorney, Agent, or Firm* — Andrus Intellectual Property Law, LLP

(57) ABSTRACT

A product display unit for displaying products on a shelf includes a sidewall at least partially defining a track configured to receive products, the sidewall comprising a first panel and a second panel with a sidewall hinge therebetween. A base panel is coupled to the sidewall, and the base panel is configured to be positioned on the shelf and deform in shape to conform to the shape of the shelf. The sidewall hinge comprises a first leg and a second leg, each with an upper end and a lower end. The sidewall hinge includes an upper transition section connecting the respective upper ends of the first and second legs, a first lower transition section connecting the lower end of the first leg to the first panel, and a second lower transition section connecting the lower end of the second leg to the second panel.

20 Claims, 10 Drawing Sheets

(56) References Cited

U.S. PATENT DOCUMENTS 5,265,738 A * 11/1993 Yablans ..... A47F 1/126 211/59.3
5,624,042 A * 4/1997 Flum ..... A47F 1/12 403/334
5,645,176 A * 7/1997 Jay ..... A47F 5/0043 211/74
5,971,173 A * 10/1999 Valiulis ..... A47F 5/005 211/184
6,044,989 A * 4/2000 Sosso ..... A47F 5/005 211/184
6,142,316 A * 11/2000 Harbour ..... A47F 1/12 211/74
6,244,447 B1 * 6/2001 Frieze ..... A61L 2/26 206/370
6,357,606 B1 * 3/2002 Henry ..... A47F 1/126 211/59.3
6,398,044 B1 * 6/2002 Robertson ..... A47F 1/12 211/59.2
6,615,995 B2 * 9/2003 Primiano ..... A47F 1/12 211/74
D482,913 S * 12/2003 Lingvall ..... A47B 57/583 D6/706
6,739,461 B1 * 5/2004 Robinson ..... A47F 1/12 428/116
8,016,139 B2 * 9/2011 Hanners ..... A47F 5/005 211/184
8,104,630 B2 * 1/2012 Schneider ..... A47F 5/005 211/184
8,556,092 B2 * 10/2013 Valiulis ..... A47F 5/005 211/175
9,277,831 B2 * 3/2016 Hardy ..... A47F 1/04
9,538,860 B2 * 1/2017 Brej ..... A47F 1/126
9,622,594 B2 * 4/2017 Gommermann ..... A47F 1/12
9,861,211 B2 * 1/2018 Miller, Jr. ..... H05K 999/99
9,949,577 B2 * 4/2018 Botta ..... A47F 5/0068
10,219,639 B2 * 3/2019 Howard ..... A47F 1/125
10,398,239 B1 * 9/2019 Luberto ..... A47F 5/0025
11,800,928 B2 * 10/2023 Gatto ..... A47B 96/021
2001/0045402 A1 * 11/2001 Hawley ..... A47B 96/02 211/183
2002/0043509 A1 * 4/2002 Lajeunesse ..... A47F 1/087 211/74
2003/0132178 A1 * 7/2003 Jay ..... A47B 96/021 211/175
2005/0139560 A1 * 6/2005 Whiteside ..... A47B 57/586 211/119.003
2006/0032827 A1 * 2/2006 Phoy ..... A47F 1/12 211/74
2007/0175844 A1 * 8/2007 Schneider ..... A47F 5/005 211/184
2013/0020270 A1 * 1/2013 Valiulis ..... A47F 5/005 211/184
2014/0360953 A1 * 12/2014 Pichel ..... A47F 1/04 211/59.3
2023/0346138 A1 * 11/2023 Illers ..... A47F 1/12

* cited by examiner

PRODUCT DISPLAY UNITS WITH HINGES

CROSS-REFERENCE TO RELATED APPLICATION

The present disclosure is based on and claims priority to U.S. Provisional Patent Application No. 63/336,385 filed Apr. 29, 2022, the disclosure of which is incorporated herein by reference.

FIELD

The present disclosure relates to product display units, and specifically to product display units with hinges.

BACKGROUND

The following U.S. Patent is incorporated herein by reference in entirety.

U.S. Pat. No. 9,622,594 discloses a product display unit for use on a shelf having a track configured to support a plurality of products thereon.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples, a product display unit for displaying products on a shelf includes a sidewall at least partially defining a track configured to receive products, the sidewall comprising a first panel and a second panel with a sidewall hinge therebetween. A base panel is coupled to the sidewall, and the base panel is configured to be positioned on the shelf and deform in shape to conform to the shape of the shelf. The sidewall hinge comprises a first leg and a second leg, each with an upper end and a lower end. The sidewall hinge also includes an upper transition section connecting the respective upper ends of the first and second legs and defining a cutout between the first and second legs, a first lower transition section connecting the lower end of the first leg to the first panel, and a second lower transition section connecting the lower end of the second leg to the second panel.

Optionally, the first leg and the second leg are mirror images of each other. Optionally, the first leg and the second leg are configured to elastically move relative to each other as the base panel applies stresses onto the sidewall. Optionally, the first leg and the second leg extend parallel to each other. Optionally, the first leg and the second leg extend transverse to each other. Optionally, the upper transition section has a semi-annular shape. Optionally, an upper end of the upper transition section vertically aligns with an upper end of the first panel and an upper end of the second panel. Optionally, the base panel has a first base panel surface and the cutout vertically extends below the first base panel surface thereby exposing a side base surface. Optionally, the sidewall extends along and covers a side surface of the base panel. Optionally, the sidewall hinge is a first sidewall hinge and further comprising a second sidewall hinge coupled to one of the first panel and the second panel. Optionally, the sidewall is a first sidewall and the sidewall hinge is a first sidewall hinge and further comprising a second sidewall coupled to the base panel and spaced apart from the first sidewall such that the track is between the first sidewall and the second sidewall, the second sidewall comprising a second sidewall hinge. Optionally, the second sidewall hinge has a first leg and the second leg that are configured to elastically move relative to each other as the base panel applies stresses onto the second sidewall. Optionally, the first sidewall hinge and the second sidewall hinge are aligned with each other. Optionally, each lower transition section includes a lower extension that extends vertically to the base panel. Optionally, the base panel has a first base surface and the sidewall vertically extends below the first base surface. Optionally, the base panel comprises a first base panel section and a second base panel section with a base panel hinge therebetween such that the first base panel section and the second base panel section pivot relative to each other. Optionally, the base panel hinge is a living hinge. Optionally, the base panel hinge is aligned with the cutout. Optionally, the base panel hinge extends perpendicular to the sidewall. Optionally, the base panel hinge is a first base panel hinge, and further comprising a second base panel hinge coupled to the first base panel section.

Various other features, objects, and advantages will be made apparent from the following description taken together with the drawings.

BRIEF DESCRIPTION OF THE DRAWINGS

The present disclosure is described with reference to the following Figures. The same numbers are used throughout the Figures to reference like features and like components.

DETAILED DESCRIPTION

Figure 1:
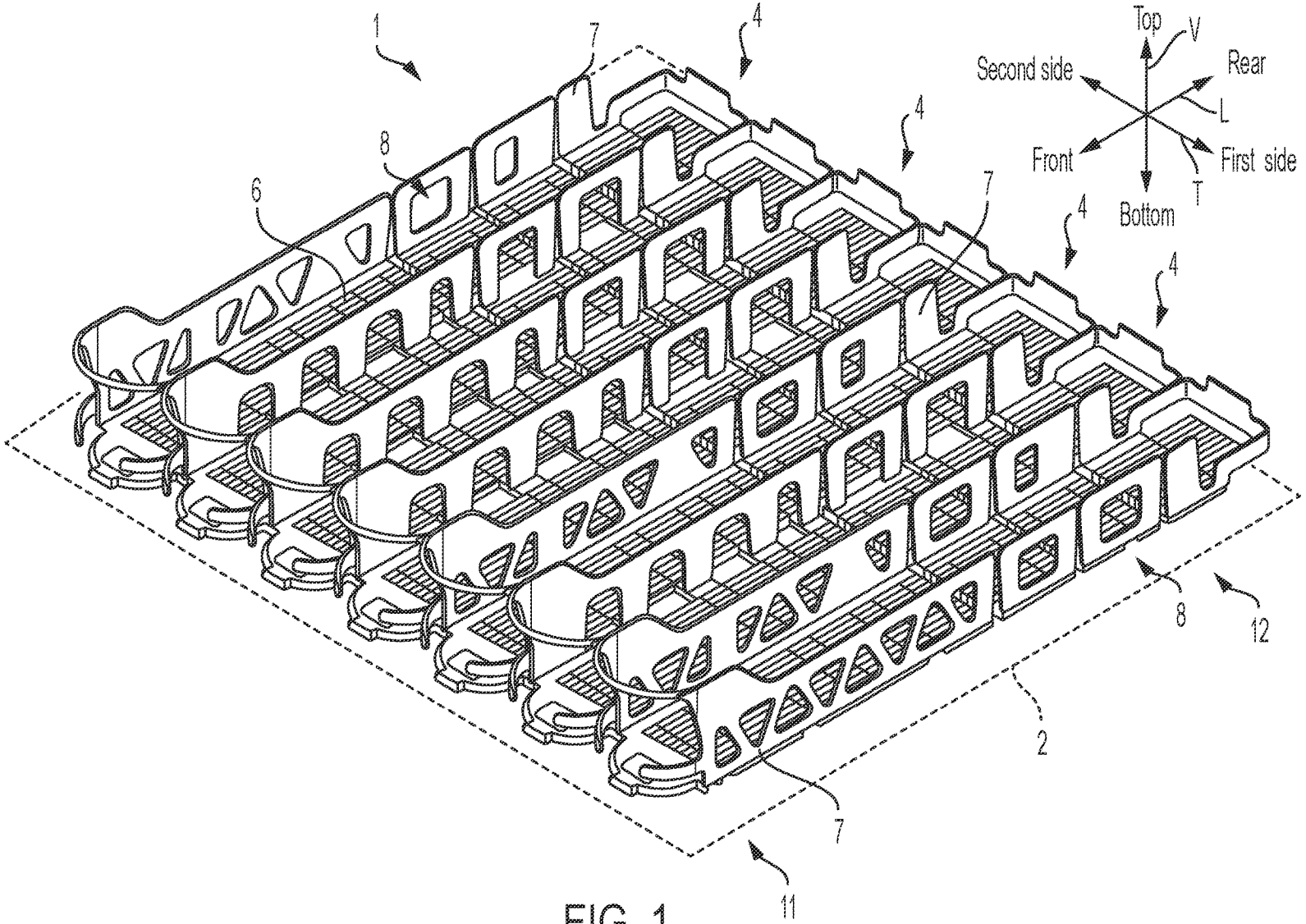
FIG. 1 PRIOR ART
FIG. 1 is a front perspective view of a conventional product display unit.

FIGS. 1-4 depict a conventional product display unit 1 for displaying products (not shown; e.g., soda bottles or cans) to customers. The product display unit 1 can be placed on a shelf 2 (note the shelf 2 is schematically depicted in dashed lines), such as a wire shelf of a refrigerator, in a retail or convenience store setting. The product display unit 1 generally vertically extends between a top and a bottom (see example axis V), transversely between a first side and an opposite second side (see example axis T), and longitudinally between a front and a rear (see example axis L). The product display unit 1 includes a base panel 6 and a plurality of sidewalls 7 that define a plurality of tracks 4 in which the products (not shown) can be placed. The products (not shown) are urged from a rear end 12 toward a front end 11 of the product display unit 1 by gravity or one or more pushers (not shown). Note that the sidewalls 7 have a plurality of material openings 8 that decrease the weight of the sidewalls 7 and the amount of material (e.g., plastic) necessary to form the sidewalls 7. Also note that the sidewalls 7 are continuously or intermittently coupled to the panel 6 (e.g., adhesives, fastners).

Figure 2:
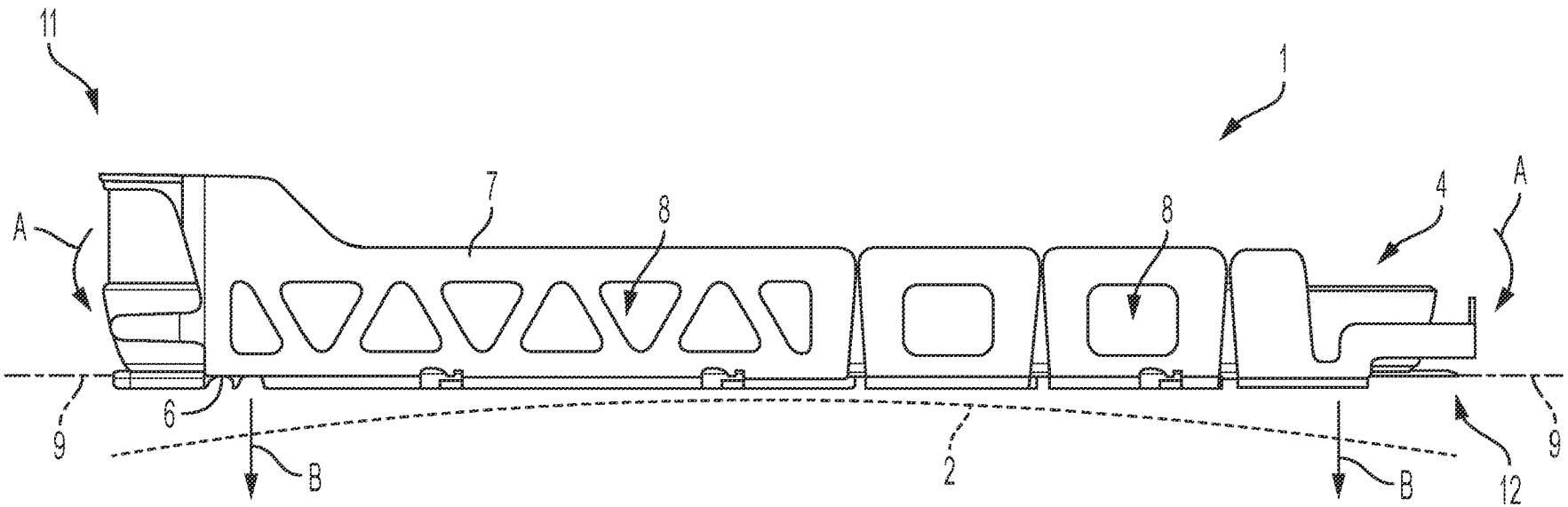
FIG. 2 PRIOR ART
FIG. 2 is a side view of the product display unit of FIG. 1.

The present inventors have observed that the shelves 2 on which the product display units 1 are positioned may not be perfectly level and/or flat due to manufacturing tolerances or defects, normal wear, and/or damage. Furthermore, certain types of shelves 2 are manufactured with a camber (see FIG. 2) that counteracts or opposes weight of the product display unit 1 or products placed thereon. In contrast, conventional product display units 1 are manufactured with a flat base panel 6 that generally extends in a plane 9 (FIG. 2; e.g., the plane 9 is horizontal). Thus, the shape of the base panel 6 as manufactured may not correspond to the shape of the shelf 2, and accordingly, when the product display unit 1 is placed on the shelf 2, the weight of the base panel 6, the sidewalls 7, and/or the products thereon (not shown) tend to cause the base panel 6 and/or the sidewalls 7 to deform or flex. In one example, the base panel 6 tends to flex out of the plane 9 and deform into a shape that corresponds to the shape of the shelf 2. As such, the base panel 6 applies stresses (e.g., pulling forces) into the sidewalls 7 which cause the sidewalls to deform, as described hereinbelow.

In another example, as depicted in FIG. 2, when the product display unit 1 is initially placed on the shelf 2, sections of the base panel 6 near each opposing end 11, 12 tend to flex (see arrow A) toward the cambered shelf 2 under force of gravity and/or the weight of the products placed thereon. As the base panel 6 flexes and deforms, the base panel 6 applies stresses onto the sidewalls 7 via the connections therebetween thereby causing the sidewalls 7 to deform. For example, the base panel 6 tends to downwardly "pull" the sidewalls 7 toward the shelf 2 (see arrow B) such that the sidewalls 7 deform (described further hereinbelow; see FIG. 4).

Figure 3:
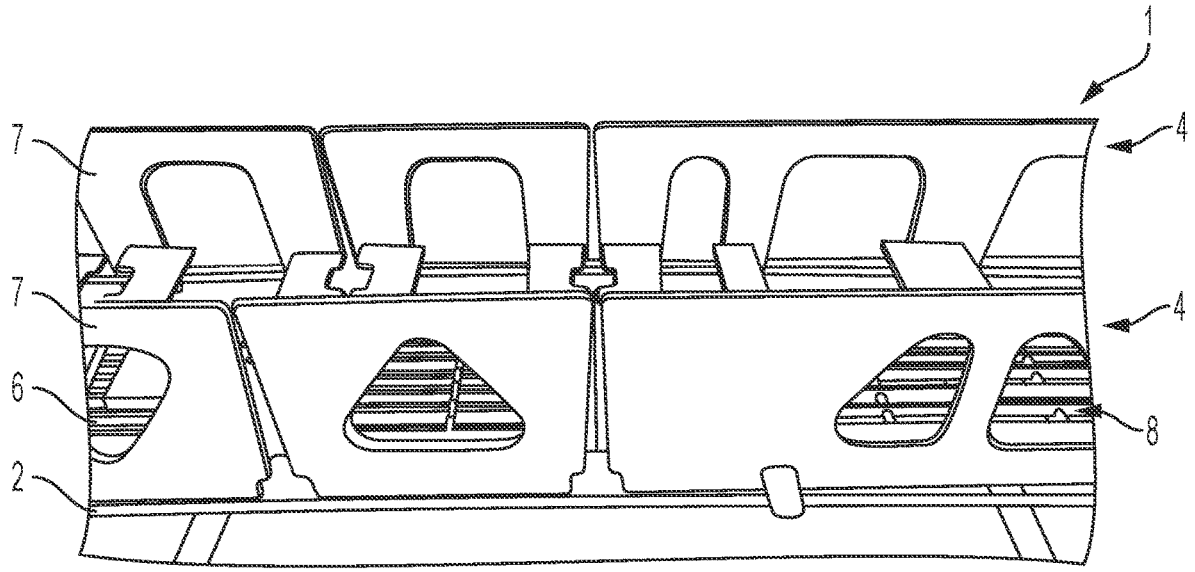
FIG. 3 PRIOR ART
FIG. 3 is a side perspective view of another conventional product display unit.
Figure 4:
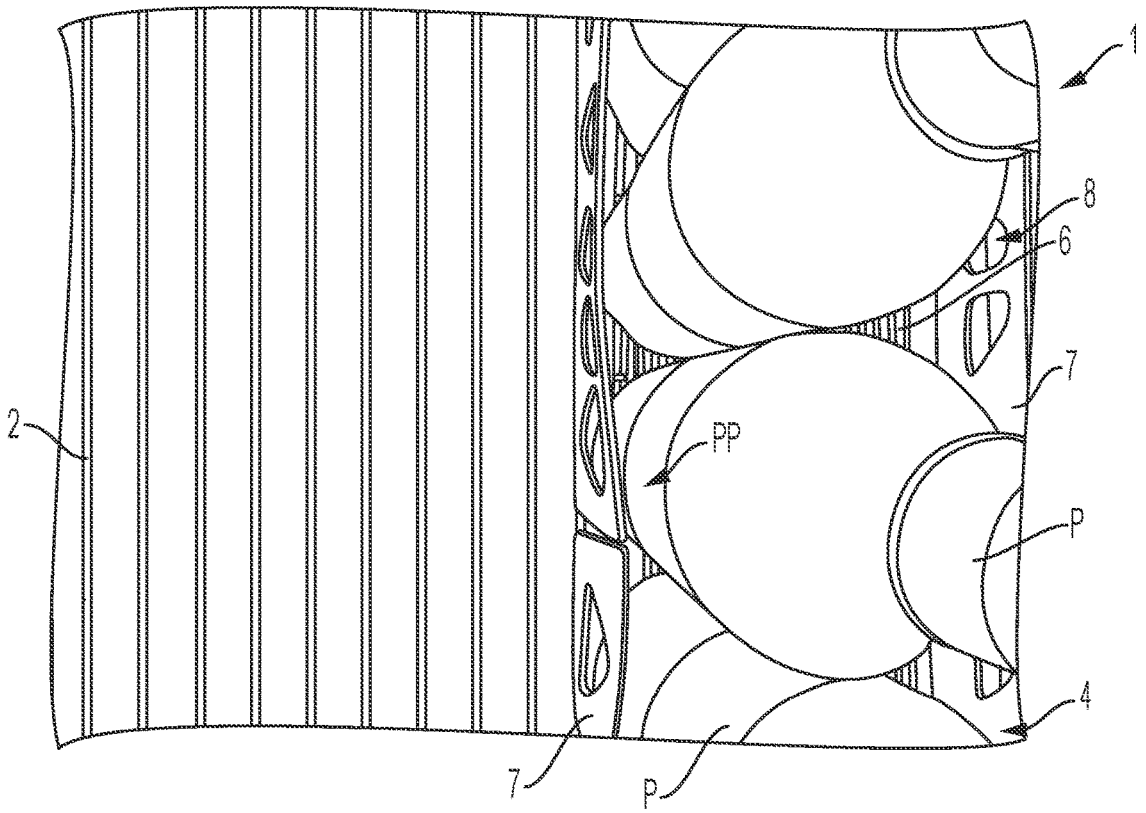
FIG. 4 PRIOR ART
FIG. 4 is a top-down perspective view of another conventional product display unit with products located in a track.
Figure 5:
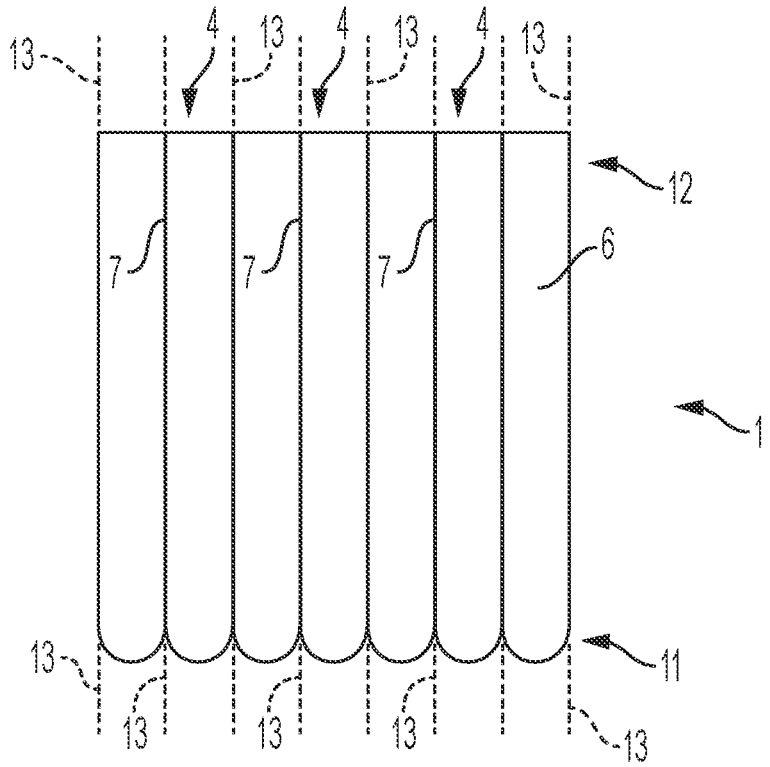
FIG. 5 PRIOR ART
FIG. 5 is a top-down schematic plan view of another conventional product display unit when the product display unit is not on a shelf.
Figure 6:
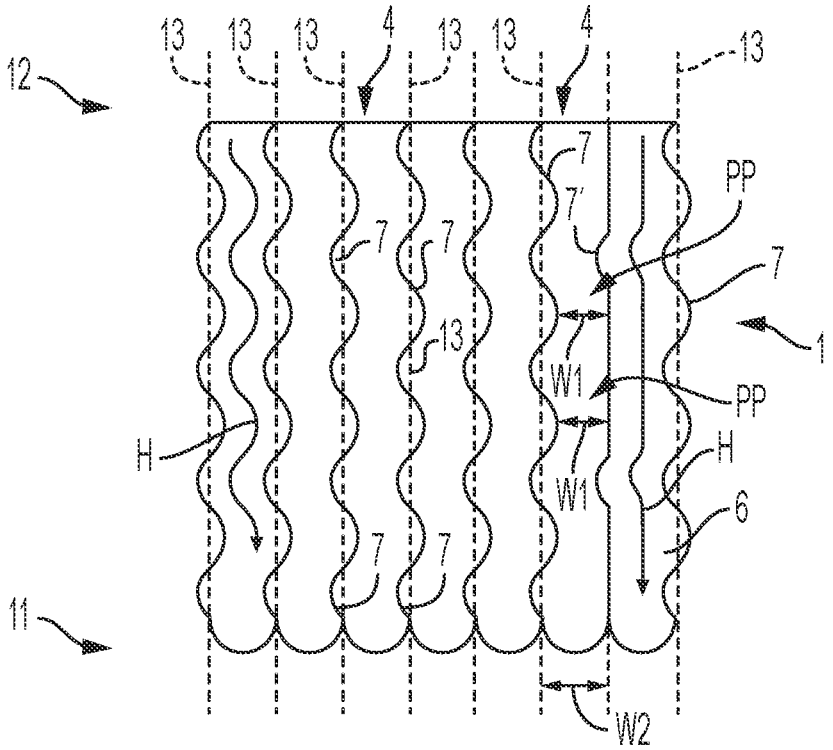
FIG. 6 PRIOR ART
FIG. 6 is a top-down schematic plan view of the conventional product display unit of FIG. 5 when the product display unit is on the shelf and the sidewalls are deformed.

FIG. 5 schematically depicts a top-down view of an example product display unit 1 before it is placed onto a shelf 2 (FIG. 1) as described above. Note that each sidewall 7 linearly extends along a separate sidewall plane 13 that extend away from and transverse to the base panel 6 (see dashed lines on FIGS. 5-6). The distance between sidewalls 7 defines the nominal width of the track 4 and which is configured for receipt and movement of products therein. FIG. 6 schematically depicts the product display unit 1 after it is placed on the shelf 2 (FIG. 2). In this example, the base panel 6 is not flat and accordingly, the base panel 6 deforms under its own weight, the weight of the sidewalls 7, and/or the weight of the products placed on the base panel 6 while positioned onto the shelf 2. As such, the base panel 6 acts on the sidewalls 7 such that the sidewalls 7 may deform and thereby move out of their respective sidewalls planes 13 (e.g., the lower ends of the sidewalls 7 may remain coupled to the base panel 26 while the upper ends of the twist or move out of the normal plane on the sidewall 7 resulting in a deformed or warped sidewall 7). For illustrative purposes, FIG. 6 depicts the upper ends of several of the sidewalls 7 depicted as deformed into serpentine shapes and the sidewalls 7 are no longer planar and are instead curved or wavy. Note that the deformation of each sidewall 7 can vary (e.g., the shape of each deformed sidewall 7 is different), and in the example depicted in FIG. 6, several of the deformed sidewalls 7 have a serpentine shape. Note that variation between the deformation in adjacent sidewalls results in a varying effective width of the track 4 along the longitudinal length of the track 4. For illustrative purposes, one of the sidewalls 7' is depicted deformed into a shape different than the shapes of the adjacent sidewalls 7. In certain examples, one or more sidewalls 7 may deform such that the sidewall 7 extends out of its sidewall plane 13 and into the track 4 thereby reducing effective width of the track 4 through which a product can pass and/or creating a 'pinch point' PP that prevents or slows flow of products P toward the front end 11 of the product display unit 1 (see also FIG. 4). Note that FIG. 3 depicts sidewalls 7 of a conventional product display unit 1 in undeformed states.

Deformation of the sidewalls 7 may prevent free movement of the products in the tracks 4. For instance, deformed sidewalls 7 (see FIG. 6) may cause the products to move side-to-side and contact the sidewalls 7 thereby slowing the movement of the products in the tracks 4 (see an example product paths depicted by arrows H on FIG. 6). The deformed sidewalls 7 may also create one or more "pinch points" PP that may cause one or more products to become stuck in the tracks 4. For example, FIG. 6 depicts several "pinch points" along one of the tracks 4 and the width of the track 4 at each "pinch point" PP (see W1) is less than the nominal or effective width (see W2) of the track 4, for example between reference adjacent sidewall plane lines 13.

The present inventors have endeavored to invent new product display units that minimize or eliminate the deformation of the sidewalls and thereby prevent the products from becoming stuck in the tracks. Accordingly, through research and experimentation, the present inventors have invented the below-described product display units of the present disclosure.

Figure 7:
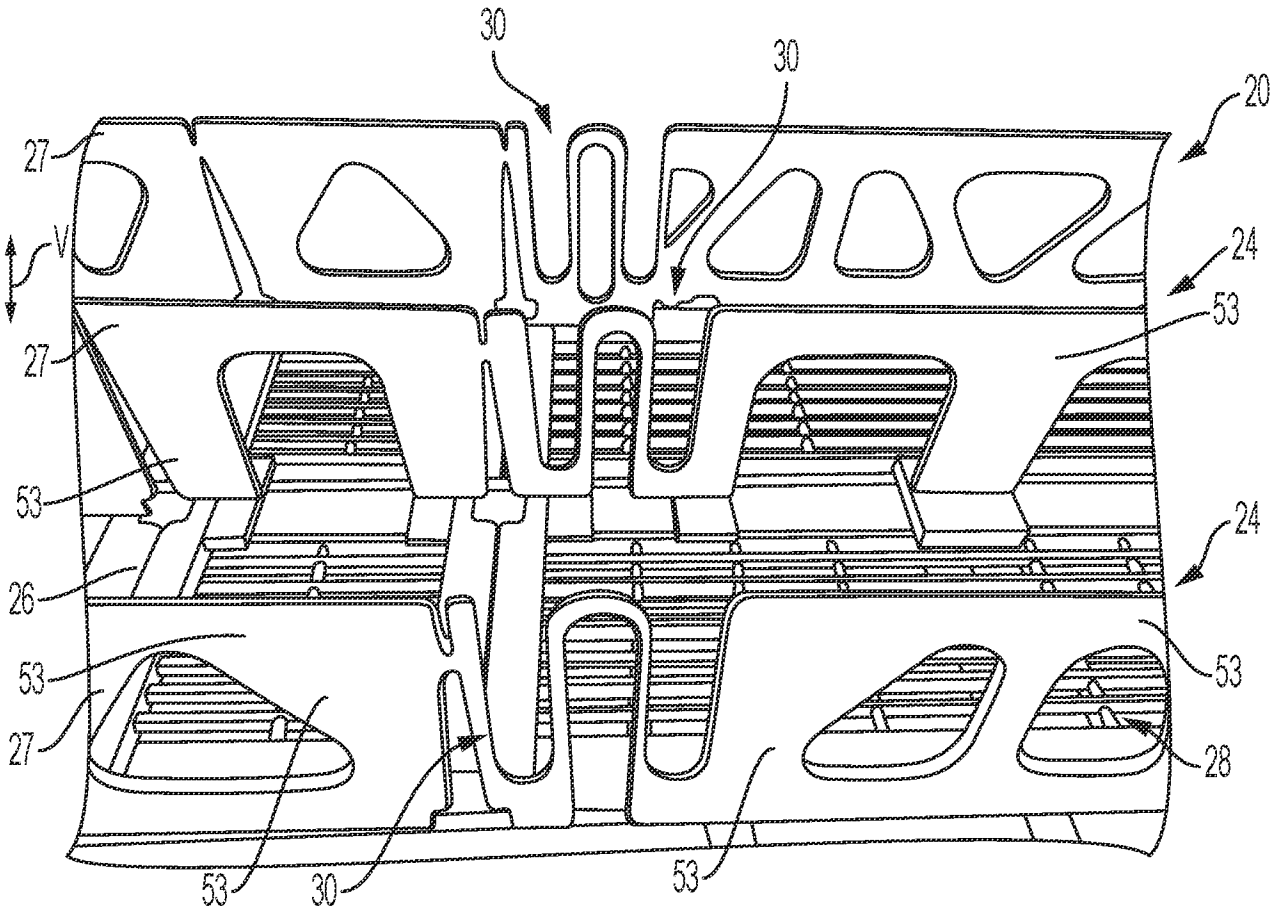
FIG. 7 is a side perspective view of an example product display unit of the present disclosure.
Figure 8:
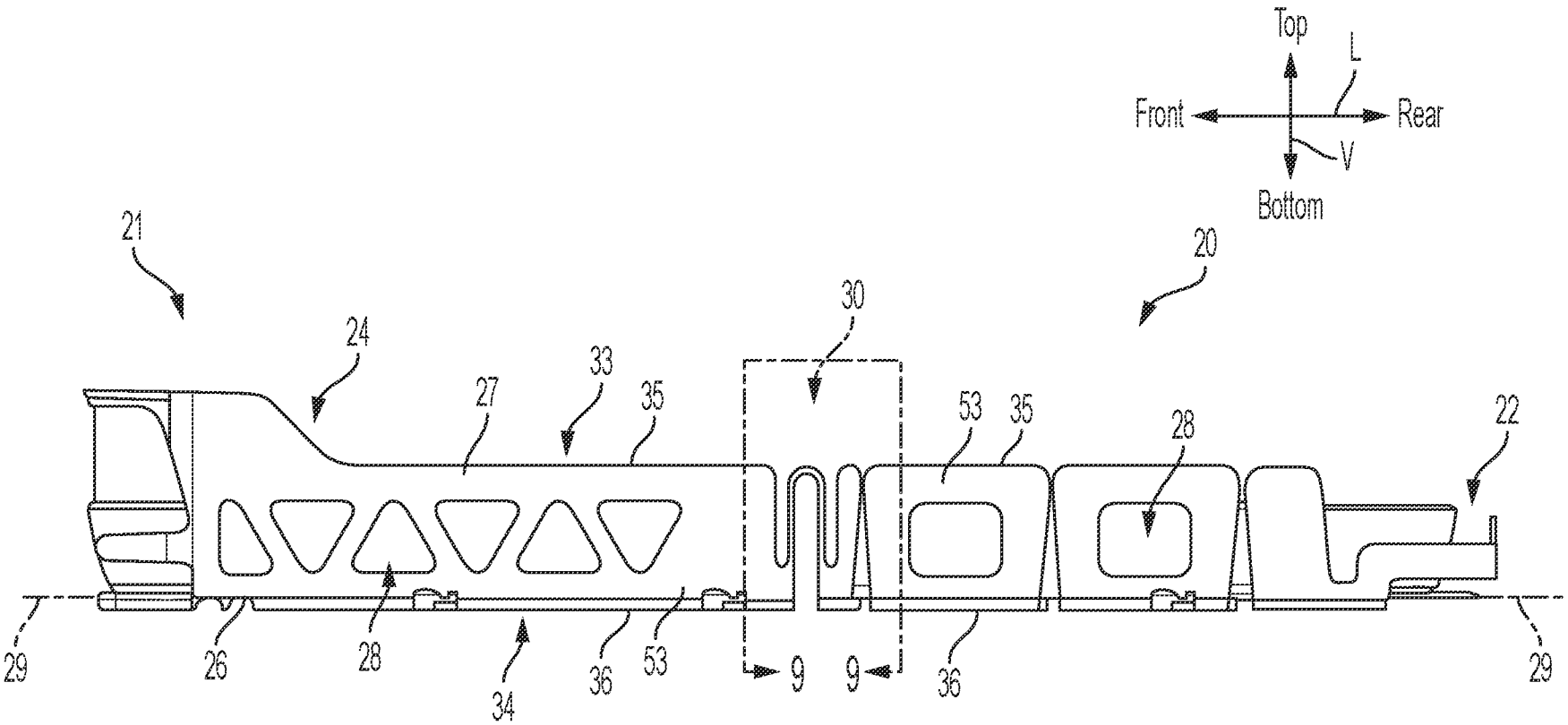
FIG. 8 is a side view of an example product display unit of the present disclosure.

FIG. 8 is a side view of a product display unit of the present disclosure, and FIG. 7 depicts a partial view of the product display unit 20. In particular, FIG. 7 depicts the center section of the product display unit 20 without depicting its ends 21, 22 of the product display unit 20. The product display unit 20 has a base panel 26 that extends in a plane 29 (FIG. 8) and a plurality of sidewalls 27. The sidewalls 27 define a plurality of tracks 24 in which products (not shown) are positioned, and the sidewalls 27 comprise one or more panels 53 with material cutouts 28 defined therein.

As will be described in greater detail herein below, the sidewalls 27 include one or more sidewall hinges 30 and/or base panel hinges 61 that minimize deformation of the panel 53 into the tracks 24 and/or the overall deformation of the sidewalls 27 when the product display unit 20 rests on a shelf 2 (see FIG. 1) having a shape different than the shape of the base panel 26 (as discussed above; e.g., the shelf 2 is cambered). When the product display unit 20 is placed on a shelf 2, the base panel 26 tends to conform to the shape of the shelf 2 (as described above) and thereby apply stresses onto the sidewalls 27 such that one or more sidewall hinges 30 and/or base panel hinges 61 move (described herein below). The sidewall hinges 30 and/or the base panel hinges 61 prevent or reduce movement or deformation of the other components of the sidewalls 27, such as the panels 53, out of the sidewall plane 39 (see FIG. 10). In certain examples, the sidewall deformation is localized to the sidewall hinges 30 and overall lateral deformation of the sidewalls 27 is reduced in comparison to the deformation of the sidewalls in conventional product display units. The sidewall hinges 30 and the base panel hinges 61, are described in greater detail hereinbelow with respect to FIGS. 9-13. In one non-limiting example, a sidewall hinge 30 acts as a stress-relieving element in the sidewall 27 designed to relieve stress in other portions of the sidewall 27 such as the panels 53. Note that the sidewalls 27 and the base panels 26 define the tracks 24. In certain examples, the sidewalls 27 extend along and cover the side surface 88 (FIG. 9) of the base panel 26.

Figure 9:
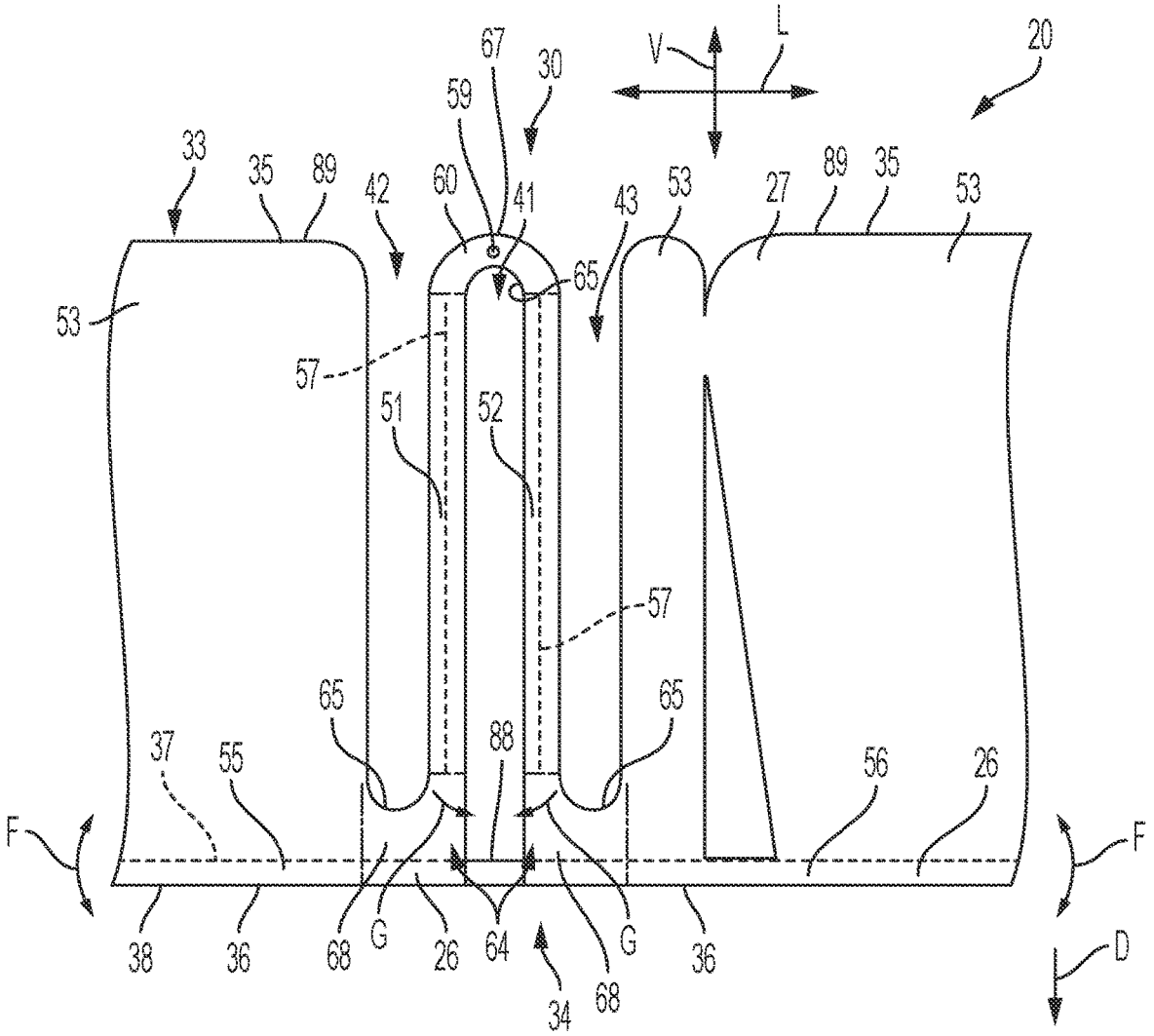
FIG. 9 is an enlarged view within line 9-9 on FIG. 8.

FIG. 9 is an enlarged view of a section of the sidewall 27 (within lines 9-9 in FIG. 8) in which a sidewall hinge 30 is located. The hinge 30 is located between the ends 21, 22 of the sidewall 27. The sidewall hinge 30 joins adjacent panels 53 of the sidewall 27 which may be coupled to the base panel 26. The sidewall hinge 30 includes a pair of opposing legs, namely a first leg 51 and a second leg 52. In certain examples, the legs 51, 52 are mirror images of each other. The upper ends of the legs 51, 52 are joined to each other with an upper transition section 60 (note that the lower extent of the upper transition section 60 is noted with dashed lines and the upper end 67 of the upper transition section 60). The upper end 67 is vertically aligned with the upper end 89 of the panels 53. The upper transition section 60 joins the legs 51, 52 such that the legs 51, 52 are elastically movable relative to each other and/or the adjacent panels 53. In certain examples, the upper transition section 60 defines a pivot point 59 about which the legs 51, 52 move relative to each other. In certain examples, the legs 51, 52 each extend along a leg axis 57 and the leg axis 57 are parallel to each other when the sidewall hinge 30 is not deformed. In certain examples, the upper transition section 60 has a semi-annular shape.

The opposite lower ends of the legs 51, 52 are joined to the adjacent panels 53, respectively, by lower transition sections 64 (note the lower transition sections 64 are partially defined with dash-dot lines on FIG. 9). The upper transition section 60 and the lower transition sections 64 each include a curved edge 65 that is adjacent to a cutout 41, 42, 43 (described below) of the sidewall hinge 30. Each lower transition section 64 has a lower extension 68 that extends to the base panel 26. The lower extension 68 extend along and covers the side surface 88 of the base panel 26. In other examples, the lower extension 68 extends to the upper first base surface 37 (FIG. 10) of the base panel 26.

A first cutout 41 is defined between the legs 51, 52 and by the upper transition section 60, and the first cutout 41 extends between the upper transition section 60 and a bottom 34 of the sidewall 27 that is adjacent to the base panel 26. Note that the bottom 34 is opposite a top 33 of the sidewall 27 and that the top 33 has a top edge 35 and the bottom 34 has a bottom edge 36. Further note that the first cutout 41 extends through the bottom 34 of the sidewall 27 such that the bottom edge 36 is not continuous.

The sidewall hinge 30 further includes a second cutout 42 next to one of legs 51 and a third cutout 43 next to the other leg 52. The second and third cutouts 42, 43 vertically extend from the top 33 of the sidewall 27 to the lower transition sections 64. The second and third cutouts 42, 43 extend through the top 33 of the sidewall 27 such that the top edge 35 is not continuous.

Figure 10:
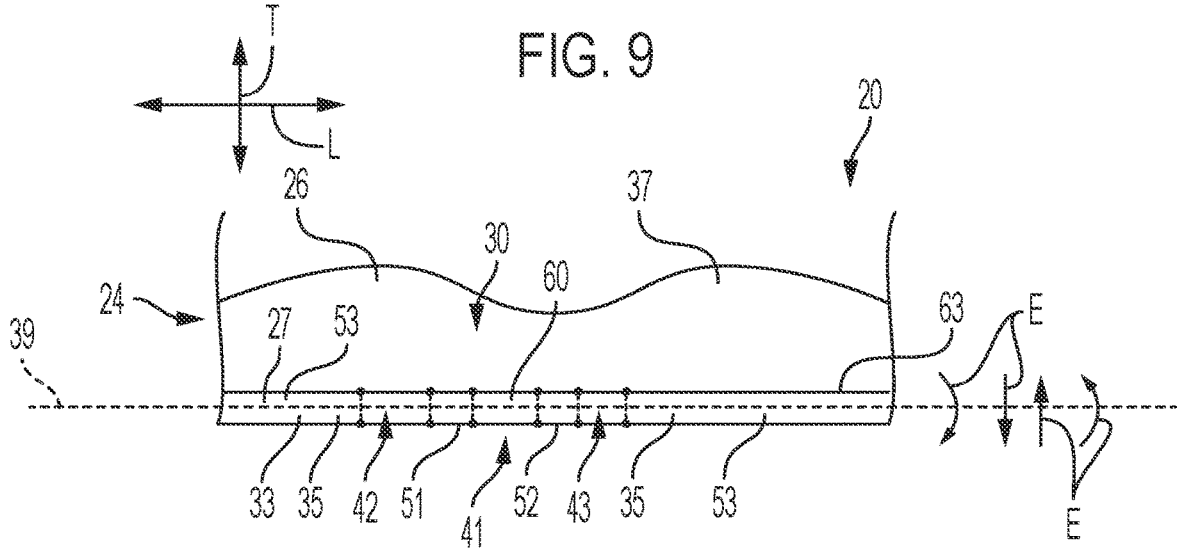
FIG. 10 is a partial top-down plan view of the product display unit of FIG. 8.

FIG. 10 depicts a top-down partial plan view of an example product display unit 20 looking downwardly at the top 33 of one of the sidewalls 27. The sidewall 27, including the legs 51, 52 and the panels 53, extend along the sidewall plane 39 (note that the sidewall plane 39 is depicted generally as a dashed line on FIG. 10). When the product display unit 20 is placed onto a shelf 2 and/or products are placed onto the product display unit 20, the base panel 26 deforms (as described above; see arrow D on FIG. 9 indicating vertical movement and deformation of the base panel 26) thereby applying stresses onto the sidewalls 27. The stresses cause the sidewall hinge(s) 30 to move (e.g., the legs 51, 52 twist and/or open in a transverse direction). The legs 51, 52 move relative to each other such that the sidewall hinge 30 minimizes the deformation of other components of the sidewall 27, such as the panels 53. The movement of the legs 51, 52 varies based on the stresses applied to the sidewalls 27 via placement of objects onto the base panel 26 or as the base panel 26 deforms under force of gravity to the shape of the underlying shelf 2. In certain examples, the stresses cause the legs 51, 52 to move toward each other such that the width of the first cutout 41 decreases, the lower transition sections 64 move toward each other (see arrows G on FIG. 9), and the widths of the second and third cutouts 42, 43 to increase. In certain examples, legs 51, 52 can twist or rotate relative to each other and/or move out of the sidewall plane 39 (see non-limiting example movements of the legs 51, 52 noted by movement arrows E). In certain examples, the legs 51, 52 pivot relative to each other about the pivot point 59 (FIG. 9).

Note that the legs 51, 52 can act like a thin flexible hinge integrally formed from the same material as the adjacent panels 53 (e.g., a "living hinge"). However, in other examples, the sidewall hinge 30 is a separate component that is connected to the panels 53 (e.g., the sidewall hinge 30 is a separable component of the sidewall 27). In these examples, the sidewall hinge 30 is not integrally formed into the sidewall 27 and is instead coupled to the panels 53 is any suitable manner.

In certain examples, the sidewall hinges 30 in adjacent sidewalls 27 are aligned with each other. In one example, the sidewall hinges 30 in adjacent sidewalls 27 are transversely aligned with each other along a transversely extending axis extending between the sidewalls 27. However, in other examples, the sidewall hinges 30 are longitudinally offset from each other. A person of ordinary skill in the art will recognize that the number of hinges 30 in the sidewall(s) 27 can vary. For instance, FIG. 8 depicts one sidewall hinge 30 in each sidewall 27, and in other instances, multiple hinges 30 may be included in each sidewall 27.

Figure 11:
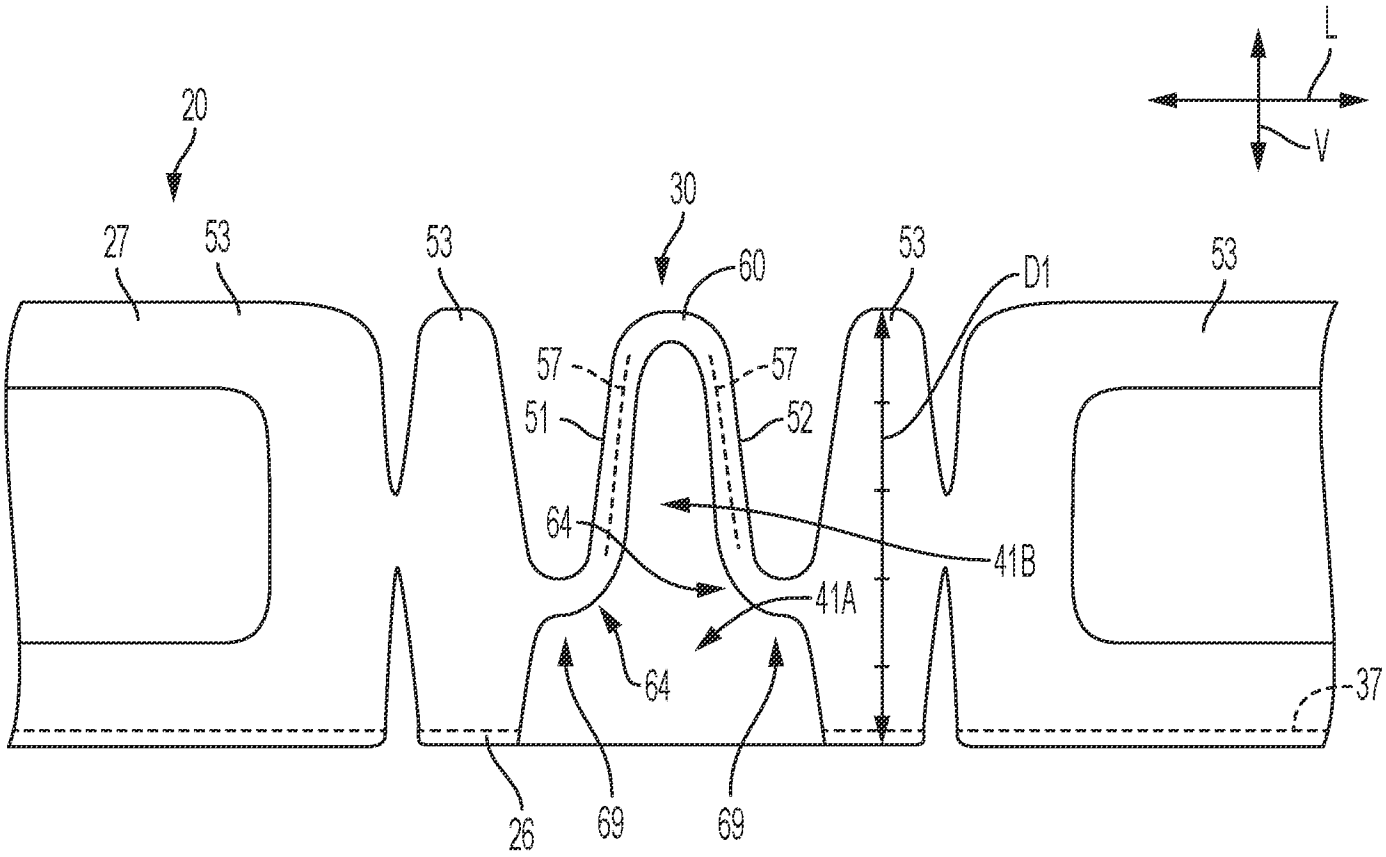
FIG. 11 is a side view of another product display unit of the present disclosure.

Referring now to FIG. 11, a side view of another example product display unit 20 is depicted. The sidewall hinge 30 is located between the ends 21, 22 of the product display unit 20 between panels 53. In this example, the hinge 30 joins the adjacent panels 53 via the lower transition section 64. Note that the lower transition sections 64 in this example do not include lower extensions 68 (see lower extensions 68 on the example depicted in FIG. 9) and instead, open space 69 is below the lower transition sections 64. The present inventors discovered that connecting the lower ends of the legs 51, 52 to the adjacent panels 53 without lower extensions 68 advantageously permits the legs 51, 52 to move (e.g., flex, rotate) when the product display unit 20 is placed onto a shelf and/or products are placed onto the product display unit 20. The stresses generated as the base panel 26 deforms are applied to the hinge 30 via the adjacent panels 53 which causes the hinge 30 to deform and/or the legs 51, 52 move relative to each other. The sidewall hinge 30, as noted above, minimizes the movement and deformation of other components of the sidewall 27, such as the panels 53.

The present inventors have recognized that in certain examples locating the attachment point of the legs 51, 52 via the lower transition sections 64 to the panels 53 near the base panel 26 (e.g., along the lower half of the panel 53), as oppose to away from the base panel 26 (e.g., along the upper half of the panel 53), reduces the amount of force or load necessary to start flexing the hinge 30. That is, the hinge 30 begins to flex under lower amounts of stresses or forces applied by the base panel 26 to the sidewall 27 when the lower transition sections 64 are connected to the panels 53 near the base panel 26. As such, as the shape of the base panel 26 begins to conform to the shape of the underlying shelf, the hinge 30 reduces or prevents deformation of the sidewall 27 (e.g., the hinge 30 is 'actuated' earlier to prevent deformation in the sidewall 27 panel 26 instead of waiting to receive a greater amount of force or stresses from the base panel 26). Note that in example depicted in FIG. 11, the cutout between the legs 51, 52 has a wide lower section 41A and upper section 41B that is narrow relative to the lower section 41A.

Figure 12:
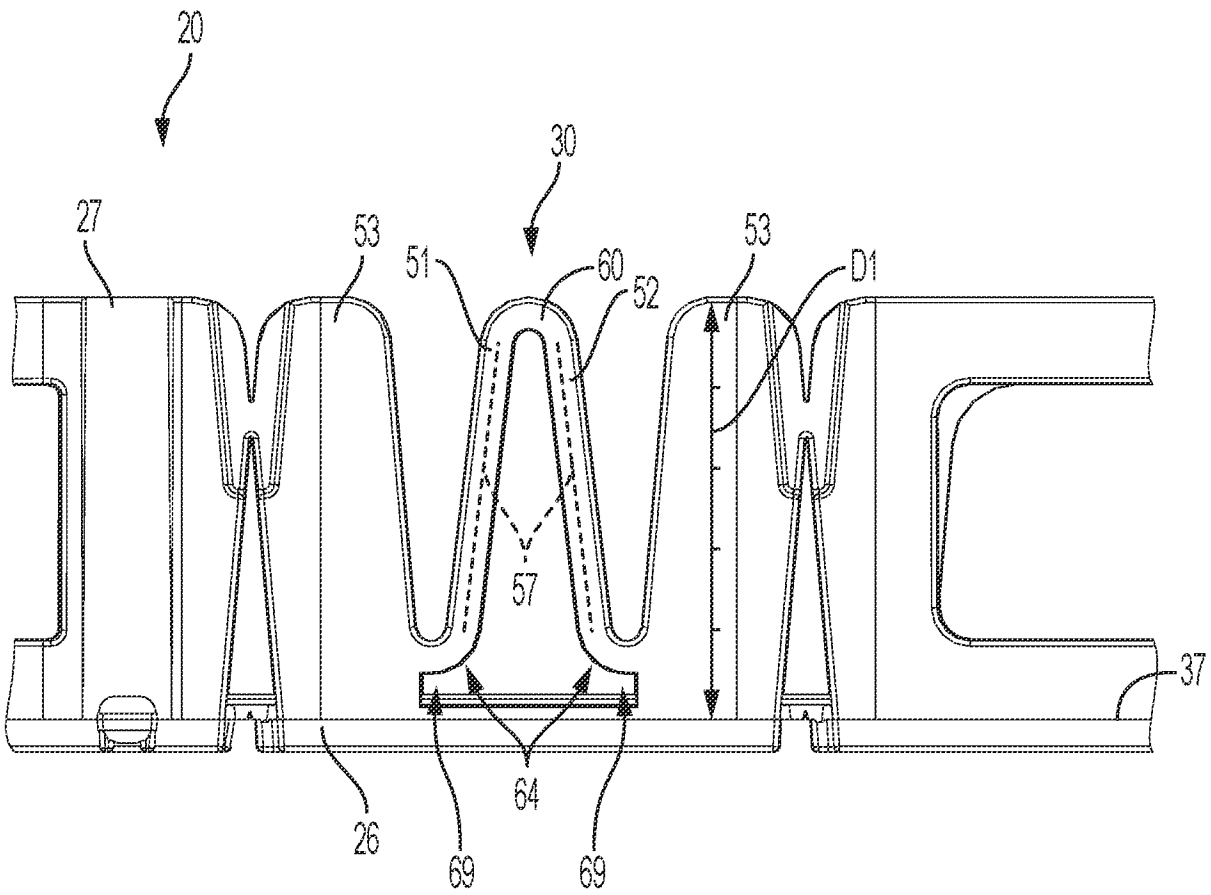
FIG. 12 is a side view of another product display unit of the present disclosure.

FIG. 12 is a side view of another example product display unit 20. In this example, the bottom surface of the sidewall 27 rests on the top surface of the base panel 26. The legs 51, 52 are attached to adjacent panels 53 via the lower transition sections 64. The lower transition sections 64 are connected to the lower portion of the panel 53. Like the example depicted in FIG. 11, the lower transition sections 64 do not include lower extension 68 (see FIG. 9). In certain examples, the lower transition sections 64 are connected the lower portion of the panel at a position in the range of the lower half to the lower hundredth of the panel 53 (see height arrow D1 representing the height of the panel 53). In the example depicted in FIG. 11, the lower transition sections 64 is connected to the lower third of the panel 53. In the example depicted in FIG. 12, the lower transition sections 64 is connected to the lower fifth of the panel. In another example, the lower transition sections 64 are connected to the lower twentieth of the panel 53. In another example, the lower transition sections 64 are connected to the lower portion of the panel 53 at a position in the range of the lower third to the lower tenth the panel 53.

Figure 13:
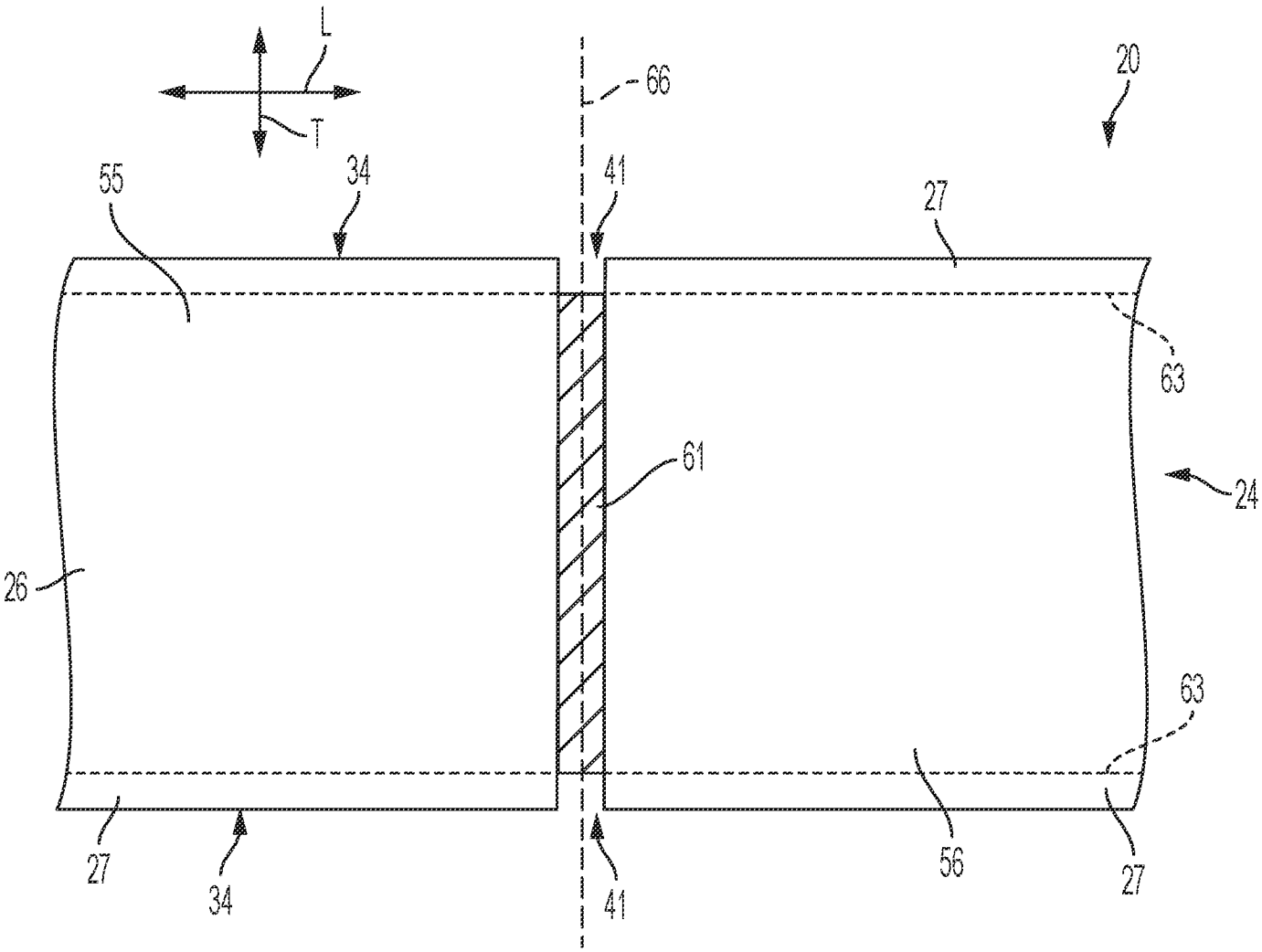
FIG. 13 is bottom-up plan view of the product display unit of FIG. 8.

Referring now to FIG. 13, a bottom-up plan view of an example product display unit 20 is depicted with the inside edges 63 of the sidewalls 27 shown as dashed lines for clarity. The first cutouts 41 of the sidewalls 27 define a base panel hinge 61 in the base panel 26 (depicted as the cross-hatched section of FIG. 13). In this example, the first cutouts 41 extend along the exterior side surfaces of the base panel 26 such that the sidewalls 27 are not connected to the base panel 26 at the location of the first cutouts 41 (see also FIG. 9). The area of the base panel 26 that extends between the first cutouts 41 (in directions that extend between the sidewalls 27) defines the base panel hinge 61 about which the base panel 26 can pivot and/or bend. The base panel hinge 61 extends along a base panel axis 66. In certain examples, the base panel hinge 61 aligns with the cutout 41. The base panel hinge 61 is between a first base section 55 of the base panel 26 and a second base section 56 of the base panel 26 and accordingly, these base sections 55, 56 can pivot relative to each other about the base panel hinge 61 and the base panel axis 66 (see movement arrows F on FIG. 9 depicting potential movement of the base sections 55, 56). The movement of base sections 55, 56 relative to each other helps to relieve or minimize stresses that may otherwise be applied by the base panel 26 to the sidewalls 27 (as described above). Note that the base panel hinge 61 can act like a thin flexible hinge integrally formed from the same material as the adjacent base sections 55, 56 (e.g., the base panel hinge 61 acts like a "living hinge") and thereby minimizes deformation of the sidewalls 27. In other examples, the base panel hinge 61 is a removable component that connects the base sections 55, 56. In certain examples, only one of the first cutouts 41 extends along the exterior surface of the base panel 26. In certain examples, the first cutout 41 first cutout vertically extends below the upper first base surface 37 thereby exposing a side base surface 75 (FIG. 9). Note that in certain examples, the products in the tracks 24 freely move over the base panel hinge 61.

Note that in certain examples, that the width of the base panel hinge 61 corresponds to the width of the first cutout 41. In certain examples, the sidewall 27 extends along the base panel 26 in such a way that the bottom edge 36 of the sidewall 27 aligns with the lower, bottom second base surface 38 (FIG. 9) of the base panel 26. In other examples, the sidewall 27 extends past the second base surface 38 (FIG. 9) of the base panel 26 such that the bottom edge 36 of the sidewall 27 is vertically below the bottom second base surface 38 of the base panel 26. In another example, the bottom 34 of the sidewall 27 is coupled to the upper first base surface 37 (FIG. 10) of the base panel 26. In this example, the base panel 26 can include one or more notches (not shown) that align with the first cutouts 41 such the notches define the base panel hinge 61. The size of the notches can vary, and in certain examples, the notches extend inwardly past the inside edge 63 of the sidewall 27.

In certain examples, a product display unit for displaying products on a shelf includes a sidewall at least partially defining a track configured to receive products, the sidewall comprising a first panel and a second panel with a sidewall hinge therebetween. A base panel is coupled to the sidewall, and the base panel is configured to be positioned on the shelf and deform in shape to conform to the shape of the shelf. The sidewall hinge comprises a first leg and a second leg, each with an upper end and a lower end. The sidewall hinge also includes an upper transition section connecting the respective upper ends of the first and second legs and defining a cutout between the first and second legs, a first lower transition section connecting the lower end of the first leg to the first panel, and a second lower transition section connecting the lower end of the second leg to the second panel.

Optionally, the first leg and the second leg are mirror images of each other. Optionally, the first leg and the second leg are configured to elastically move relative to each other as the base panel applies stresses onto the sidewall. Optionally, the first leg and the second leg extend parallel to each other. Optionally, the first leg and the second leg extend transverse to each other. Optionally, the upper transition section has a semi-annular shape. Optionally, an upper end of the upper transition section vertically aligns with an upper end of the first panel and an upper end of the second panel. Optionally, the base panel has a first base panel surface and the cutout vertically extends below the first base panel surface thereby exposing a side base surface. Optionally, the sidewall extends along and covers a side surface of the base panel. Optionally, the sidewall hinge is a first sidewall hinge and further comprising a second sidewall hinge coupled to one of the first panel and the second panel. Optionally, the sidewall is a first sidewall and the sidewall hinge is a first sidewall hinge and further comprising a second sidewall coupled to the base panel and spaced apart from the first sidewall such that the track is between the first sidewall and the second sidewall, the second sidewall comprising a second sidewall hinge. Optionally, the second sidewall hinge has a first leg and the second leg that are configured to elastically move relative to each other as the base panel applies stresses onto the second sidewall. Optionally, the first sidewall hinge and the second sidewall hinge are aligned with each other. Optionally, each lower transition section includes a lower extension that extends vertically to the base panel. Optionally, the base panel has a first base surface and the sidewall vertically extends below the first base surface. Optionally, the base panel comprises a first base panel section and a second base panel section with a base panel hinge therebetween such that the first base panel section and the second base panel section pivot relative to each other. Optionally, the base panel hinge is a living hinge. Optionally, the base panel hinge is aligned with the cutout. Optionally, the base panel hinge extends perpendicular to the sidewall. Optionally, the base panel hinge is a first base panel hinge, and further comprising a second base panel hinge coupled to the first base panel section.

In certain examples, the base panel is configured to be positioned on the shelf and deform as shape of the base panel conforms to the shape of the shelf and/or in response to weight of the products received into the track. As the base panel deforms, the base panel applies stresses to the sidewall. In certain examples, the first sidewall hinge and the second sidewall hinge collectively relieve stresses applied by the base panel onto the first sidewall and/or the second sidewall.

Citations to a number of references are made herein. The cited references are incorporated by reference herein in their entireties. In the event that there is an inconsistency between a definition of a term in the specification as compared to a definition of the term in a cited reference, the term should be interpreted based on the definition in the specification.

In the present description, certain terms have been used for brevity, clarity, and understanding. No unnecessary limitations are to be inferred therefrom beyond the requirement of the prior art because such terms are used for descriptive purposes and are intended to be broadly construed. The different apparatuses, systems, and method steps described herein may be used alone or in combination with other apparatuses, systems, and methods. It is to be expected that various equivalents, alternatives and modifications are possible within the scope of the appended claims.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A product display unit for displaying products on a shelf, the product display unit comprising:

a sidewall at least partially defining a track configured to receive products, the sidewall comprising a first panel and a second panel with a sidewall hinge therebetween; and a base panel coupled to the sidewall, wherein the base panel is configured to be positioned on the shelf and deform in shape to conform to the shape of the shelf;

wherein the sidewall hinge comprises:

a first leg and a second leg, each with an upper end and a lower end;

an upper transition section connecting the respective upper ends of the first and second legs and defining a cutout between the first and second legs;

a first lower transition section connecting the lower end of the first leg to the first panel; and a second lower transition section connecting the lower end of the second leg to the second panel.

2. The product display unit according to claim 1, wherein the first leg and the second leg are mirror images of each other.

3. The product display unit according to claim 1, wherein the first leg and the second leg are configured to elastically move relative to each other as the base panel applies stresses onto the sidewall.

4. The product display unit according to claim 1, wherein the first leg and the second leg extend parallel to each other.

5. The product display unit according to claim 1, wherein the first leg and the second leg extend transverse to each other.

6. The product display unit according to claim 1, wherein the upper transition section has a semi-annular shape.

7. The product display unit according to claim 1, wherein an upper end of the upper transition section vertically aligns with an upper end of the first panel and an upper end of the second panel.

8. The product display unit according to claim 1, wherein the base panel has a first base panel surface and the cutout vertically extends below the first base panel surface thereby exposing a side base surface.

9. The product display unit according to claim 1, wherein the sidewall extends along and covers a side surface of the base panel.

10. The product display unit according to claim 1, wherein the sidewall hinge is a first sidewall hinge; and further comprising a second sidewall hinge coupled to one of the first panel and the second panel.

11. The product display unit according to claim 1, wherein the sidewall is a first sidewall and the sidewall hinge is a first sidewall hinge; and further comprising:

a second sidewall coupled to the base panel and spaced apart from the first sidewall such that the track is between the first sidewall and the second sidewall, the second sidewall comprising a second sidewall hinge.

12. The product display unit according to claim 11, wherein the second sidewall hinge has a first leg and the second leg that are configured to elastically move relative to each other as the base panel applies stresses onto the second sidewall.

13. The product display unit according to claim 12, wherein the first sidewall hinge and the second sidewall hinge are aligned with each other.

14. The product display unit according to claim 1, wherein each lower transition section includes a lower extension that extends vertically to the base panel.

15. The product display unit according to claim 1, wherein the base panel has a first base surface and the sidewall vertically extends below the first base surface.

16. The product display unit according to claim 1, wherein the base panel comprises a first base panel section and a second base panel section with a base panel hinge therebetween such that the first base panel section and the second base panel section pivot relative to each other.

17. The product display unit according to claim 16, wherein the base panel hinge is a living hinge.

18. The product display unit according to claim 16, wherein the base panel hinge is aligned with the cutout.

19. The product display unit according to claim 16, wherein the base panel hinge extends perpendicular to the sidewall.

20. The product display unit according to claim 16, wherein the base panel hinge is a first base panel hinge, and further comprising a second base panel hinge coupled to the first base panel section.

* * * * *